US007849544B2

(12) United States Patent
Flocard et al.

(10) Patent No.: US 7,849,544 B2
(45) Date of Patent: Dec. 14, 2010

(54) SUPPORT DEVICE OF THE MATTRESS TYPE COMPRISING A HETEROGENEOUS INFLATABLE STRUCTURE

(75) Inventors: Thierry Flocard, Montpellier (FR); Gilles Camus, Montpellier (FR)

(73) Assignee: Hill-Rom Industries SA, Montpellier (FR)

( * ) Notice: Subject to any disclaimer, the term of this patent is extended or adjusted under 35 U.S.C. 154(b) by 19 days.

(21) Appl. No.: 12/137,769

(22) Filed: Jun. 12, 2008

(65) Prior Publication Data

US 2008/0307582 A1 Dec. 18, 2008

(30) Foreign Application Priority Data

Jun. 18, 2007 (FR) ..... 07 55812

(51) Int. Cl.
*A47C 27/10* (2006.01)

(52) U.S. Cl. ..... 5/710; 5/712; 5/713; 5/722

(58) Field of Classification Search ..... 5/710, 5/713, 714, 722
See application file for complete search history.

(56) References Cited

U.S. PATENT DOCUMENTS

| | | | |
|---|---|---|---|
| 1,147,560 | A | 7/1915 | Shurtleff |
| 1,772,310 | A | 8/1930 | Hart |
| 2,437,006 | A | 3/1948 | Simpson |
| 2,460,245 | A | 1/1949 | Summerville |
| 2,719,986 | A | 10/1955 | Rand |
| 2,896,612 | A | 7/1959 | Bates et al. |
| 2,998,817 | A | 9/1961 | Armstrong |
| 3,008,465 | A | 11/1961 | Gal |
| 3,148,391 | A | 9/1964 | Whitney |
| 3,199,124 | A | 8/1965 | Grant |
| 3,297,023 | A | 1/1967 | Foley |
| 3,317,934 | A | 5/1967 | Hinrichs |
| 3,390,674 | A | 7/1968 | Jones |
| 3,394,415 | A | 7/1968 | Parker |
| 3,446,203 | A | 5/1969 | Murray |
| 3,462,778 | A | 8/1969 | Whitney |
| 3,467,081 | A | 9/1969 | Glass |
| 3,595,223 | A | 7/1971 | Castagna |
| 3,653,083 | A | 4/1972 | Lapidus |
| 3,674,019 | A | 7/1972 | Grant |

(Continued)

FOREIGN PATENT DOCUMENTS

| | | |
|---|---|---|
| EP | 0676158 | 11/1995 |

(Continued)

*Primary Examiner*—Robert G Santos
*Assistant Examiner*—Brittany M Wilson
(74) *Attorney, Agent, or Firm*—Barnes & Thornburg LLP

(57) ABSTRACT

A mattress has at least one inflatable top layer made up of a plurality of adjacent elements that are individually inflatable by a pneumatic inflation and pressure regulation device and at least one bottom layer supporting the top layer. The bottom layer has a recess for receiving a sensor connected to the pneumatic inflation and pressure regulation device, and making it possible to determine the pressure applied by the body of an individual bearing against the inflatable top layer and to regulate the inflation pressures of the elements of the top layer. In at least one support zone designed to support the sacrum of an individual, the top layer is made up of a plurality of inflatable elements that are of a width smaller than their height.

22 Claims, 3 Drawing Sheets

U.S. PATENT DOCUMENTS

| | | | | |
|---|---|---|---|---|
| 3,678,520 | A | 7/1972 | Evans | |
| 3,701,173 | A | 10/1972 | Whitney | |
| 3,919,730 | A | 11/1975 | Regan | |
| 4,066,072 | A | 1/1978 | Cummins | |
| 4,068,334 | A | 1/1978 | Randall | |
| 4,133,305 | A | 1/1979 | Steuer | |
| 4,175,297 | A | 11/1979 | Robbins et al. | |
| 4,181,288 | A | 1/1980 | Bylsma | |
| 4,193,149 | A | 3/1980 | Welch | |
| 4,197,837 | A | 4/1980 | Tringali et al. | |
| 4,225,989 | A | 10/1980 | Corbett et al. | |
| 4,267,611 | A | 5/1981 | Agulnick | |
| 4,391,009 | A | 7/1983 | Schild et al. | |
| 4,551,874 | A | 11/1985 | Matsumura et al. | |
| 4,617,690 | A | 10/1986 | Grebe | |
| 4,622,706 | A | 11/1986 | Takeuchi | |
| 4,644,593 | A | 2/1987 | O'Brien | |
| 4,653,130 | A | 3/1987 | Senoue et al. | |
| 4,722,105 | A | 2/1988 | Douglas | |
| 4,730,604 | A | 3/1988 | Boggs | |
| 4,745,647 | A * | 5/1988 | Goodwin | 5/713 |
| 4,777,679 | A | 10/1988 | DeLooper | |
| 4,825,486 | A | 5/1989 | Kimura et al. | |
| 4,837,872 | A | 6/1989 | DiMatteo et al. | |
| 4,840,425 | A | 6/1989 | Noble | |
| 4,852,195 | A | 8/1989 | Schulman | |
| 4,999,861 | A | 3/1991 | Huang | |
| 5,003,654 | A | 4/1991 | Vrzalik | |
| 5,008,965 | A | 4/1991 | Vrzalik | |
| 5,010,608 | A | 4/1991 | Barnett et al. | |
| 5,022,385 | A | 6/1991 | Harza | |
| 5,029,939 | A | 7/1991 | Smith et al. | |
| 5,035,016 | A | 7/1991 | Mori et al. | |
| 5,044,029 | A | 9/1991 | Vrzalik | |
| 5,077,845 | A | 1/1992 | Tokunaga et al. | |
| 5,103,518 | A | 4/1992 | Gilroy et al. | |
| 5,105,488 | A * | 4/1992 | Hutchinson et al. | 5/710 |
| 5,109,560 | A | 5/1992 | Uetake | |
| 5,109,561 | A | 5/1992 | Schild | |
| 5,117,518 | A | 6/1992 | Schild | |
| 5,138,729 | A | 8/1992 | Ferrand | |
| 5,142,719 | A | 9/1992 | Vrzalik | |
| 5,189,742 | A | 3/1993 | Schild | |
| 5,243,723 | A | 9/1993 | Cotner et al. | |
| 5,251,349 | A | 10/1993 | Thomas et al. | |
| 5,255,955 | A | 10/1993 | Matosic | |
| 5,257,430 | A | 11/1993 | Yamaguchi | |
| 5,267,364 | A | 12/1993 | Volk | |
| 5,267,365 | A | 12/1993 | Walter | |
| 5,269,030 | A | 12/1993 | Pahno et al. | |
| 5,313,679 | A | 5/1994 | Yamaguchi | |
| 5,345,629 | A | 9/1994 | Ferrand | |
| 5,357,641 | A | 10/1994 | Schubert | |
| 5,379,471 | A | 1/1995 | Holdredge | |
| 5,396,671 | A | 3/1995 | Stacy | |
| 5,419,347 | A | 5/1995 | Carruth | |
| 5,438,721 | A | 8/1995 | Pahno et al. | |
| 5,509,155 | A | 4/1996 | Zigarac et al. | |
| 5,537,095 | A | 7/1996 | Dick et al. | |
| 5,564,142 | A | 10/1996 | Liu | |
| 5,586,346 | A | 12/1996 | Stacy et al. | |
| 5,588,167 | A | 12/1996 | Pahno et al. | |
| 5,603,133 | A | 2/1997 | Vrzalik | |
| 5,606,754 | A | 3/1997 | Hand et al. | |
| 5,619,764 | A | 4/1997 | Lopau | |
| 5,638,565 | A | 6/1997 | Pekar | |
| 5,651,151 | A | 7/1997 | Schild | |
| 5,662,384 | A | 9/1997 | O'Neill et al. | |
| 5,666,681 | A * | 9/1997 | Meyer et al. | 5/727 |
| 5,678,891 | A | 10/1997 | O'Neill et al. | |
| 5,685,036 | A | 11/1997 | Kopfstein et al. | |
| 5,687,438 | A | 11/1997 | Biggie et al. | |
| 5,701,622 | A | 12/1997 | Biggie et al. | |
| 5,702,536 | A | 12/1997 | Carruth | |
| 5,708,996 | A | 1/1998 | Marenco | |
| 5,713,841 | A | 2/1998 | Graham | |
| 5,745,941 | A | 5/1998 | Miller, Sr. | |
| 5,755,000 | A | 5/1998 | Thompson | |
| 5,774,917 | A | 7/1998 | Liu | |
| D397,443 | S | 8/1998 | Fletcher et al. | |
| D403,773 | S | 1/1999 | Fletcher et al. | |
| 5,901,393 | A | 5/1999 | Pepe et al. | |
| 5,918,336 | A | 7/1999 | Lee et al. | |
| 5,926,884 | A | 7/1999 | Biggie et al. | |
| 5,956,787 | A | 9/1999 | James et al. | |
| 5,960,494 | A | 10/1999 | Gilliland et al. | |
| 5,966,762 | A | 10/1999 | Wu | |
| 5,983,428 | A | 11/1999 | Hannagan | |
| 5,983,429 | A | 11/1999 | Stacy et al. | |
| 5,991,949 | A | 11/1999 | Miller, Sr. et al. | |
| 6,009,580 | A | 1/2000 | Caminade et al. | |
| 6,029,294 | A | 2/2000 | Saringer | |
| 6,053,879 | A | 4/2000 | Leban et al. | |
| 6,058,538 | A | 5/2000 | Chapman et al. | |
| 6,073,290 | A | 6/2000 | Miller, Sr. | |
| 6,079,068 | A * | 6/2000 | Viard | 5/713 |
| 6,085,372 | A | 7/2000 | James et al. | |
| 6,094,762 | A * | 8/2000 | Viard et al. | 5/713 |
| 6,098,222 | A | 8/2000 | Hand et al. | |
| 6,134,732 | A | 10/2000 | Chapman et al. | |
| 6,151,740 | A | 11/2000 | Morimoto et al. | |
| 6,202,684 | B1 | 3/2001 | Angel et al. | |
| 6,212,719 | B1 | 4/2001 | Thomas et al. | |
| 6,216,300 | B1 | 4/2001 | Hannagan | |
| 6,223,369 | B1 | 5/2001 | Maier et al. | |
| 6,266,833 | B1 | 7/2001 | Lin | |
| 6,282,737 | B1 | 9/2001 | Vrzalik | |
| 6,321,400 | B1 | 11/2001 | Gulino | |
| 6,327,727 | B1 | 12/2001 | Bocharnikov | |
| 6,349,439 | B1 | 2/2002 | Cook et al. | |
| 6,412,129 | B1 | 7/2002 | Wu | |
| 6,499,160 | B2 | 12/2002 | Hand et al. | |
| 6,536,056 | B1 | 3/2003 | Vrzalik et al. | |
| 6,546,580 | B2 | 4/2003 | Shimada | |
| 6,571,825 | B2 | 6/2003 | Stacy | |
| 6,591,437 | B1 * | 7/2003 | Phillips | 5/713 |
| 6,604,252 | B1 | 8/2003 | Lee et al. | |
| 6,653,607 | B2 | 11/2003 | Ellis et al. | |
| 6,668,408 | B2 | 12/2003 | Ferrand et al. | |
| 6,684,433 | B2 | 2/2004 | Giori et al. | |
| 6,691,355 | B1 | 2/2004 | Liu | |
| 6,711,771 | B2 | 3/2004 | Cook et al. | |
| 6,745,996 | B1 | 6/2004 | Guthrie | |
| 6,771,190 | B2 | 8/2004 | Gordon | |
| 6,789,284 | B2 | 9/2004 | Kemp | |
| 6,813,790 | B2 | 11/2004 | Flick et al. | |
| 6,820,640 | B2 | 11/2004 | Hand et al. | |
| 6,823,549 | B1 | 11/2004 | Hampton et al. | |
| 6,826,795 | B2 | 12/2004 | Wilkinson | |
| 6,854,144 | B1 | 2/2005 | Mehring, Jr. | |
| 6,877,178 | B2 | 4/2005 | Chapman et al. | |
| 6,892,405 | B1 | 5/2005 | Dimitriu et al. | |
| 6,895,988 | B2 | 5/2005 | Grant et al. | |
| 6,904,631 | B2 | 6/2005 | Vrzalik et al. | |
| 6,910,238 | B2 | 6/2005 | Biggie et al. | |
| 6,924,467 | B2 | 8/2005 | Ellis et al. | |
| 6,928,681 | B1 | 8/2005 | Stacy | |
| 7,007,330 | B2 | 3/2006 | Kuiper et al. | |
| 7,028,358 | B2 | 4/2006 | Liu | |
| 7,080,422 | B2 | 7/2006 | Ben-Levi | |
| 7,107,640 | B2 | 9/2006 | Chapman et al. | |
| 7,191,482 | B2 | 3/2007 | Romano et al. | |
| 7,203,984 | B2 | 4/2007 | Gardner et al. | |
| 7,225,486 | B2 | 6/2007 | Jackson, III | |

| | | | | |
|---|---|---|---|---|
| 7,226,471 | B2 | 6/2007 | Heaton et al. | |
| 2001/0008029 | A1 | 7/2001 | Thomas et al. | |
| 2001/0023511 | A1 | 9/2001 | Wilkinson | |
| 2002/0016995 | A1 | 2/2002 | Cook et al. | |
| 2002/0050010 | A1 | 5/2002 | Shimada | |
| 2002/0129448 | A1 * | 9/2002 | Pirzada | 5/713 |
| 2002/0133877 | A1 | 9/2002 | Kuiper et al. | |
| 2002/0133882 | A1 | 9/2002 | Chapman et al. | |
| 2002/0144343 | A1 | 10/2002 | Kuiper et al. | |
| 2003/0024051 | A2 | 2/2003 | Wilkinson | |
| 2003/0046762 | A1 * | 3/2003 | Stolpmann | 5/421 |
| 2003/0051293 | A1 | 3/2003 | Chapman et al. | |
| 2003/0145386 | A1 | 8/2003 | Kemp | |
| 2003/0182728 | A1 | 10/2003 | Chapman et al. | |
| 2003/0188388 | A1 | 10/2003 | Boso et al. | |
| 2003/0208848 | A1 | 11/2003 | Flick et al. | |
| 2003/0208849 | A1 | 11/2003 | Wilkinson | |
| 2003/0215340 | A1 | 11/2003 | Chung | |
| 2004/0068801 | A1 | 4/2004 | Wilkinson | |
| 2004/0074004 | A1 | 4/2004 | Boso et al. | |
| 2004/0112891 | A1 | 6/2004 | Ellis et al. | |
| 2004/0221391 | A1 | 11/2004 | Allen et al. | |
| 2004/0226102 | A1 | 11/2004 | Hampton et al. | |
| 2004/0237203 | A1 | 12/2004 | Romano et al. | |
| 2004/0255386 | A1 | 12/2004 | Liu | |
| 2004/0256588 | A1 | 12/2004 | Guthrie | |
| 2004/0261182 | A1 | 12/2004 | Biggie et al. | |
| 2005/0044634 | A1 | 3/2005 | Wang | |
| 2005/0125905 | A1 | 6/2005 | Wilkinson | |
| 2005/0166328 | A1 | 8/2005 | Ben-Levi | |
| 2005/0177952 | A1 | 8/2005 | Wilkinson et al. | |
| 2005/0204476 | A1 | 9/2005 | Roff et al. | |
| 2005/0262638 | A1 | 12/2005 | Libunao | |
| 2006/0075559 | A1 | 4/2006 | Skinner et al. | |
| 2006/0085919 | A1 | 4/2006 | Kramer et al. | |
| 2006/0101580 | A1 | 5/2006 | Biggie et al. | |
| 2006/0123552 | A1 | 6/2006 | Ben-Levi | |
| 2006/0253992 | A1 | 11/2006 | Chapman | |
| 2007/0101506 | A1 | 5/2007 | Pirzada | |
| 2007/0118993 | A1 | 5/2007 | Bates | |
| 2007/0143928 | A1 | 6/2007 | Biggie et al. | |
| 2007/0157391 | A1 | 7/2007 | Jackson, III | |
| 2007/0163052 | A1 | 7/2007 | Romano et al. | |
| 2007/0186349 | A1 | 8/2007 | Lipman et al. | |
| 2007/0266499 | A1 | 11/2007 | O'Keefe et al. | |

FOREIGN PATENT DOCUMENTS

| | | |
|---|---|---|
| EP | 1 884224 A2 | 2/2008 |
| FR | 2757377 | 12/1996 |
| WO | WO 99/39613 | 8/1999 |
| WO | WO 02/15835 | 2/2002 |
| WO | WO 2006/023479 | 3/2006 |

* cited by examiner

SUPPORT DEVICE OF THE MATTRESS TYPE COMPRISING A HETEROGENEOUS INFLATABLE STRUCTURE

The present application claims priority, under 35 U.S.C. §119(a), of French National Application No. 07 55812 which was filed Jun. 18, 2007 and which is hereby incorporated by reference herein.

BACKGROUND

The present disclosure relates to a support device, in particular to a device of the mattress type for supporting a body, in particular the body of a patient, and comprising a structure made up, at least in part, of a plurality of inflatable elements or cells suitable for being inflated with a fluid, in particular for being inflated with air.

The present disclosure relates particularly, but in a non-limiting manner, to support devices that are conventionally used in healthcare beds and in wheelchairs or other healthcare seats, and that are made up of inflatable elements, generally in the form of substantially cylindrical sausage-shaped tubes that extend transversely relative to the longitudinal direction of the mattress and that are disposed side-by-side in the longitudinal direction of the mattress.

In a support device of this type, which can be used, in particular, as a mattress, each inflatable element is generally provided with an air feed orifice and with an air discharge orifice, which orifices are equipped with or communicate in a substantially leaktight manner with at least one air feed means, e.g. via a solenoid valve that is itself connected to a pneumatic control device for controlling inflation of the inflatable elements of the mattress and for regulating the air pressures inside the elements.

In practice, in order to fill or inflate one of the inflatable elements of the support device, air is fed into the element via its feed orifice until the necessary pressure is reached inside the inflatable element. Conversely, in order to empty or deflate one of the inflatable elements, or in order to adjust the pressure inside the element, the feed orifice is kept closed and the air is discharged via the discharge orifice provided for that purpose, and in some instances, also provided with a solenoid valve that is also controlled by the pneumatic control device for controlling inflation.

Support devices of this type are used as mattresses for patient care because they make it possible to distribute appropriately the interface pressure, i.e. the pressure exerted locally by each point of the body on the surface of the mattress, as a function of the morphology and of the position of the patient.

In particular, such mattresses make it possible, as a function of the number of inflatable elements implemented, to control individually the pressure, and therefore, the filling of the inflatable elements in different zones of the mattress so as to procure an appropriate distribution of interface pressure engaging each portion of the patient's body, and so as to avoid or reduce the risks of bedsores forming in zones of the body that are at risk, such as the zone of the sacrum and the zone of heels, for example.

In principle, ideal patient comfort and optimum blood circulation for avoiding bedsore formation or for reducing local pain in certain zones of the body that bear against the mattress are obtained when the bearing points of the body are redistributed over the surface of the mattress, i.e. when the pressure exerted by the various zones of the body on the mattress (which pressure is referred to as the "interface pressure") is substantially identical at all of the points of the surface of body that are in contact with the mattress and if, in addition, the surface area of the body that is contact with the mattress is as large as possible, which requires the degree to which the inflatable elements of the mattress are inflated under the various portions of the body to be adapted to control the depth to which the body penetrates into the various zones of the mattress.

For this purpose, the air pressures inside the inflatable elements are distributed by controlling the filling/emptying of the elements in accordance with certain pre-established calculations based on, and as a function of, measurements taken with sensors in, on, or below the mattress, depending on the type of sensors implemented.

Such sensors are known to the person skilled in the art and can measure the pressure exerted by the patient's body or the depth to which the patient's body penetrates into the given compartments of the mattress, as described, for example, in the Applicant's European Patent EP 0 676 158 and in the Applicant's European Patent EP 1 056 372 which are hereby incorporated by reference herein.

Controlling and regulating filling/emptying of the inflatable elements via solenoid valves also makes it possible to obtain support devices that operate in an "alternating-pressure mode" in which certain inflatable elements of the support device that are uniformly distributed along the length thereof are inflated and deflated simultaneously and in alternation. For example, one in every two elements, or two in every three elements, or indeed one in every four elements, are deflated and re-inflated, and then the elements adjacent to the previously deflated and re-inflated compartments are deflated and re-inflated.

Thus, each inflatable element of the support device is deflated/re-inflated in succession, one after another, thereby creating a sort of wave moving back and forth in the longitudinal direction of the support device and relieving the interface pressure locally, thereby locally facilitating blood circulation through the soft tissue at the interface with the surface of the support device.

Currently, support devices, in particular mattresses, incorporating such inflatable elements are frequently made up of a first layer of geometrical shape that is kept unchanging by construction and that is generally constituted by an air mattress having a casing that is not elastic, or by a layer of foam, this first layer being of thickness that is generally constant over the entire length of the mattress, forming a "bottom" mattress on which a second layer or "therapeutic" mattress is placed that is formed by juxtaposing inflatable elements that are welded (e.g., heat-sealed) or otherwise bonded together, and that are in the general shape of substantially cylindrical sausage-shaped tubes or cells extending in a direction perpendicular to the longitudinal direction of the mattress. Each of the zones of the therapeutic mattress is provided with solenoid valves and with pipes or tubes adapted to be connected to an inflation and regulation device that is generally independent from the mattress. The foam bottom mattress and the therapeutic mattress formed of inflatable cells are enclosed in a cover that is specially adapted to enable the inflatable sausage-shaped tubes of the therapeutic mattress to be fed and emptied via its pipes connected to an accompanying inflation and regulation device.

Such mattresses of structure that is at least partially inflatable make it possible to assist in preventing, and in providing effective and increased treatment of bedsores and of other lesions or pain that develop as a result of patients being kept in the recumbent position and almost immobile for prolonged periods in hospital beds, in particular by implementing cycles of alternately inflating and deflating the cells of the therapeutic mattress and by using inflation pressures for the cells that differ as a function of the various support zones for supporting the patient's body.

However, since each patient has morphology, height, weight, and pathologies that differ from those of another patient, it is desirable to improve further the comfort of inflatable-cell mattresses, and in particular their capacities for adapting the support procured by the mattress in the various zones of the patients' bodies as a function of the physical and pathological parameters of the patients, as mentioned above, and of the positions of the patients on the mattresses, in particular when going from a recumbent position to a sitting position on the mattress, for example.

In addition, currently existing inflatable-cell mattresses may sometimes also suffer from two other main drawbacks.

Air cells that are too wide give rise, for example, to large gaps in alternating-pressure mode and suffer from the drawback of letting the patient "sink down" between the air cells, mainly in the zone for supporting the sacrum. As a result, the support imparted by that zone is no longer optimized, and there is a risk of the patient feeling discomfort by bearing against the bottom layer of the mattress whose texture is different from the texture of the therapeutic mattress.

The same can also apply in particular in the zone for supporting the heels, where the very small bearing surface areas of the heels can find themselves between air cells, with the same consequences as described above.

In addition, in the event of untimely deflation of the air cells, the therapeutic mattress no longer imparts any support wherever the bottom mattress is absent and is therefore not serving as a backup support surface, in which case the risk of bedsores is also increased for the patient.

SUMMARY

According to this disclosure a support device is provided, in particular a device suitable for constituting a mattress, which device procures an increased feeling of comfort for individuals on the device, and tends to optimize its support action by redistributing the interface pressure, even in alternating-pressure mode, regardless of the position of an individual on the support device and regardless of the morphology of that individual.

Disclosed herein is a support device comprising inflatable elements, which device matches the shape of an individual's body on the mattress reasonably closely, in particular in the support zones for supporting the portions of the body that are most prone to developing bedsores, such as the sacrum and the heels.

A support device disclosed herein comprises inflatable cells that are suitable for supporting a patient with continuous backup pneumatic support even in the event that the cells fail or are damaged, pending replacement of the defective cells.

To these ends, the present disclosure discloses a support device, in particular of the mattress type, for supporting the body of an individual, the support device comprising, inside at least one outer casing:

at least one inflatable top layer made up of a plurality of adjacent elements that are secured together and that are individually inflatable with a fluid, in particular air, via a pneumatic inflation and pressure regulation device; and at least one bottom layer supporting the top layer and provided with a recess for receiving a penetration and/or pressure sensor, in particular a sensor as described in Patent EP 0 676 158 or EP 1 056 372, connected to the pneumatic inflation and pressure regulation device, the sensor making it possible to determine the penetration of the body or the pressure applied locally by the body of an individual bearing against the inflatable top layer, and to regulate the inflation pressure of the elements of the top layer correspondingly by using that data as indicated in the above-mentioned patents.

According to the present disclosure, the support device is configured so that, in at least one support zone, such as a substantially central zone designed to support the sacrum zone of a the individual's body, and, for example, a zone at which the sensor is situated, the top layer is made up of a plurality of inflatable elements that are individualized in unitary manner, and that are of a width smaller than their height, the width of the individualized inflatable elements of the central support zone being smaller than the width of the non-individualized inflatable elements of an end zone adjacent to the central support zone.

The phrase "inflatable cells that are individualized in unitary manner" is used herein to mean air cells that are made singly and independently, and that are optionally reversibly connected one to another; in particular by pipes or tubes enabling air to flow between the various cells and connected to a device for feeding air to and for regulating the inflation pressures of the cells. Thus, the individualized cells can be replaced singly. In addition, since the individualized cells are not secured together over their entire length, unlike the cells of conventional therapeutic mattresses, they have and impart greater freedom of movement in order to match more closely the curves and shapes of the patient.

In accordance with this disclosure, the term "individualized cells" is thus to be understood to mean cells made singly and connected one to another, and suitable for being replaced singly, or else cells that are independent even though they are adjacent to one another.

When sausage-shaped cells are disposed transversely relative to the longitudinal direction of the mattress and are secured to one another along their longitudinal sides, as is conventional, any variation in the volume of one cell, caused by pressure being applied to the cell, is passed on to the adjacent cells that are secured to it.

Conversely, individualized cells deform independently from one another so that the zone made up of individualized cells matches more closely the shapes of the patient on it, the cells, by being made in individualized manner, have greater stability widthwise, regardless of their levels of inflation, compared with juxtaposed cells that are welded together over their entire length.

The resulting central support zone that is formed in accordance with some embodiments of this disclosure has a greater density of cells so that there is less risk of the patient sinking through the cells, in particular in the event of deflation when the cells are inflated in an alternating-pressure mode. The characteristic of the cells being individualized taken in combination with their width being smaller, and in some instances, stabilized regardless of their level of inflation contributes to improving the support imparted by this zone and the comfort of the patient.

In some embodiments, the inflatable elements in the support zone that are individualized in unitary manner are of a width that is substantially constant regardless of the level of inflation of the individualized inflatable elements.

This makes it possible to increase the number of support points procured by the inflatable elements and to tend to optimize their distribution in the support zone when an individual's body is on the top layer of the device.

In some embodiments, the individualized elements in the support zone are constituted by sausage-shaped cells extending transversely YY' relative to the longitudinal direction XX' of the mattress and disposed side-by-side in the longitudinal direction of the mattress, the opposite side faces of each cell being connected together by tie means S giving them a width that is substantially constant regardless of their level of inflation.

In some embodiments, the tie means are constituted by a longitudinal weld extending over a portion of the length of the cells, and not reaching their ends, the weld optionally being situated substantially in the middle relative to the height of the cell.

In another embodiment, the tie means are constituted by a spacer keeping the opposite side faces of the cells a substantially constant distance apart.

The term "width" of the inflatable elements of the top layer of the device embodiments disclosed herein is used to mean their maximum dimension measured along a horizontal straight line parallel to the longitudinal direction XX' of the device. Similarly, the term "height" of the inflatable elements of the top layer is used to mean their dimension measured in a direction ZZ' perpendicular to the longitudinal direction XX' of the device.

The support device of some embodiments contemplated herein offers the characteristic of imparting better comfort as perceived by the individuals on the top layer of the device, regardless of the inflation mode of the inflatable elements of the top layer and regardless of the positions of the individuals on the device.

In particular, when the device of such embodiments is used as a medical mattress, e.g. on a healthcare bed, for example, the comfort perceived by the patients, in particular in the alternating low-pressure inflation mode, is substantially identical regardless of the positions of the torso-raising portion of the bed, whereas, with current mattresses, certain patients can, in the region of the sacrum, feel themselves bearing against the bottom layer of the mattress that supports the inflatable top layer, while the inflatable elements are being inflated and deflated in alternating-pressure mode.

The support device of some embodiments disclosed herein offers the characteristic of having a top layer which, in the support zones for supporting those portions of the body that are usually prone to developing bedsores, such as the sacrum, and optionally in all of the support zones, i.e. over the entire length of the top layer, is made up of narrower individualized inflatable elements or cells of a particular shape that procures, in the support zones in question, increased concentration of and increased proximity between the contact surfaces of the inflatable cells, thereby increasing the overall surface area of contact in the support zones in question with the body of an individual lying on the device, and thus improving the distribution of the points of contact between the body and the inflatable cells, thereby reducing the interface pressures and therefore improving the distribution of the weight of the patient over the cells, resulting in a feeling of increased comfort.

With an embodiment having pressure alternation acting on every other cell, each even individualized air cell is connected by a pipe or tube to the preceding or the following even cell; the same applies to the odd air cells, with the aim of preserving synchronism in the alternating-pressure inflation modes, in particular in the support zone for supporting the sacrum.

Such an improvement in comfort is obtained in particular whenever the width of the inflatable elements in the central zone of the top layer is at least 25% smaller, and optionally at least 50% smaller than their height.

In addition, in some embodiments, the width of the individualized inflatable elements of the top layer is substantially constant regardless of the state of inflation of the elements, thereby tending to avoid, in the alternating-pressure mode, the phenomena of spreading due to one element deflating between two other elements that are inflated, and the local feeling of flattening that results for the individuals on the device.

BRIEF DESCRIPTION OF THE DRAWINGS

Other characteristics and aspects appear from the following detailed description of various variant embodiments of the support device as contemplated by this disclosure, given with reference to the accompanying figures, in which.

DETAILED DESCRIPTION

Figure 1:
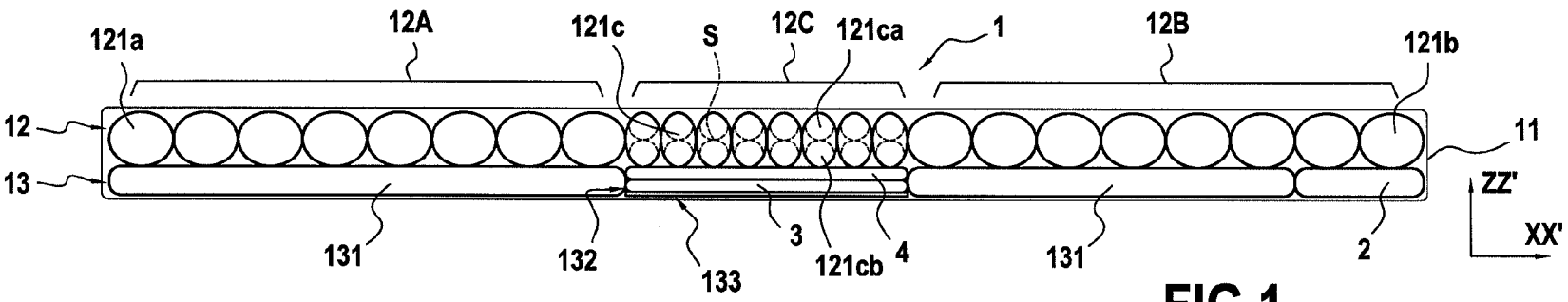
FIG. 1 is a diagrammatic longitudinal vertical section view of a mattress constituting a first embodiment of a support device according to this disclosure.

Support devices in accordance with this disclosure are described below in various variant embodiments and with reference to particularly suitable and specific uses of the support devices as mattresses for healthcare beds. FIG. 1 is a diagrammatic view of a first embodiment of a support device 1 according to this disclosure.

The support device of FIG. 1 forms a mattress that is suitable for supporting the body of an individual, in particular of a patient, and that comprises a removable cover 11 containing a top layer formed by a therapeutic mattress 12 resting on a bottom layer formed by a bottom support mattress 13.

The therapeutic mattress is made up of inflatable air elements or cells 121 that are adjacent to one another and that extend in a direction ZZ' that is perpendicular to the longitudinal direction XX' of the device 1. The inflatable elements 121 are distributed into three adjacent support zones for supporting three respective main portions of the body of an individual who is recumbent on the device 1, namely: a first zone 12A for supporting the torso and the head; a second zone 12B for supporting the legs and the feet; and a third zone 12C interposed between the zones 12A and 12B and for supporting the pelvis.

In known manner, regardless of whether it is in the central zone 12C or in one of the zones 12A, 12B, each of the inflatable elements 121 is provided with or co-operates with at least one pneumatic air feed and/or discharge means connected to and suitable for being actuated by a pneumatic inflation and pressure regulation device 2 received, in the embodiment presented, under the end of the support zone 12B and in alignment with the bottom mattress 13.

In some embodiments of the device according to this disclosure, the inflatable elements 121 of the top layer are made of a thermoplastic polymer material, in particular a material based on polyurethane (PU). Such a material offers the characteristics of being both flexible and strong and, by being thermoplastic, of being sensitive to human body heat, thereby enhancing the comfort and the flexibility of the support procured for an individual on the mattress 1.

The bottom support mattress 13 is provided with a recess for a penetration or pressure sensor 3 situated in a central position of the mattress 1 under the support zone 12C and enabling the internal pressure of the cells 121 of the therapeutic mattress 12 to be regulated by the inflation and regulation device 2 as a function of the morphology and of the position of the patient on the mattress 1.

In accordance with this disclosure, the bottom mattress 13 of the device is, like the therapeutic mattress 12, made up of a plurality of individually inflatable elements or cells 131 suitable for being connected to the pneumatic inflation and pressure regulation device 2. In this particular embodiment, the inflatable elements 131 of the bottom layer 13 of the mattress 1 are optionally made of a material of flexibility and of heat-sensitivity lower than those of the material of which the inflatable elements 121 of the therapeutic mattress are formed, so that an unchanging geometrical shape is maintained. In such embodiments, the casing of the inflatable cells 131 of the bottom mattress 13 can be made of a woven fabric, such as a polyurethane-coated Nylon® fabric.

The alternation of materials, such as polyurethane for the therapeutic mattress 12 and polyurethane-coated Nylon® for the bottom mattress 13, makes it possible for the therapeutic mattress to offer the desirable comfort and for the bottom mattress to maintain a stable geometrical shape. In addition, in the event that failure or air leakage is detected in the inflation and regulation device for inflating and regulating the pressure in the air cells 121, 131 of the top and of the bottom mattresses 12, 13, the bottom mattress 13 can be locked shut in a substantially leaktight manner, i.e. kept at substantially constant pressure, thereby guaranteeing a backup in the event of failure.

In accordance with some embodiments, and as shown in FIG. 1, the therapeutic mattress 12 comprises two end segments 12A, 12B that are made up of air cells 121*a*, 121*b*, the air cells in each segment being secured to one another and being formed by flat butt welding (e.g., heat-sealing) together two sheets of polyurethane, along weld lines that are mutually parallel. The mattress also comprises a central segment 12C that is made up of individual air cells 121*c* that are independent but adjacent to one another and that are of the same height as the cells 121*a*, 121*b* of the end segments 12A, 12B of the mattress but of smaller width, and typically half as wide as the air cells 121*a*, 121*b* that are flat butt welded together.

Figure 2:
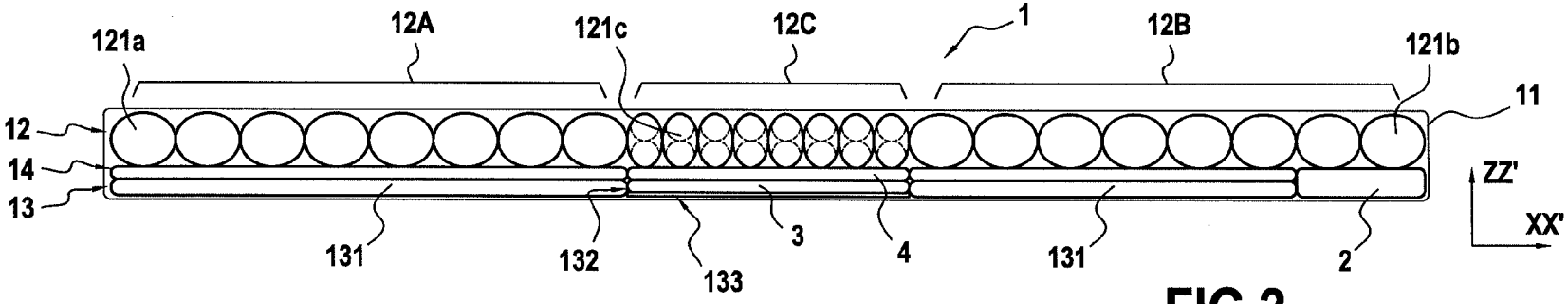
FIG. 2 is a longitudinal vertical section view of a mattress constituting a second embodiment of a support device according to this disclosure.
Figure 3:
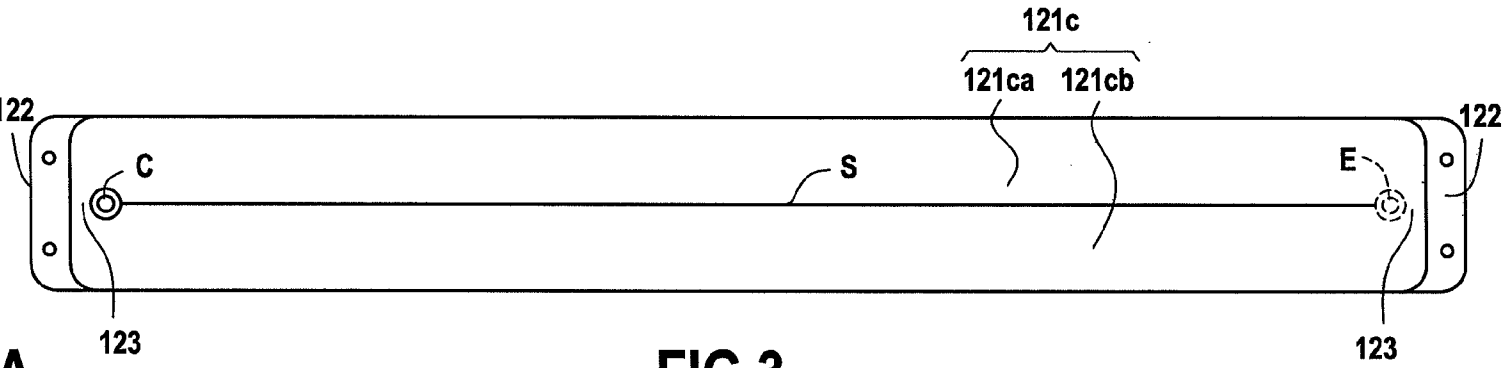
FIGS. 3 and 3A are respectively a front view (FIG. 3) and a side view (FIG. 3A) of a specific inflatable cell 121*c* of the central support zone 12C of the therapeutic mattress 12 of the support device of the embodiments shown in FIGS. 1 and 2.
Figure 3A:
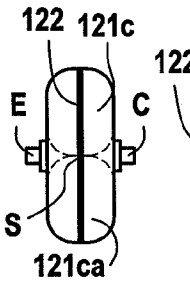

FIG. 3 shows an air cell 121*c* of the support zone 12C of the therapeutic mattress in the embodiment shown in FIGS. 1 and 2.

The individual air cells 121*c* of the segment 12C are made of a thermoplastic polyurethane, of a material identical to the material of the two segments 12A and 12B of the therapeutic mattress 12. They are also formed by flat butt welding together two sheets of polyurethane.

In FIG. 3, in the middle of each air cell 121*c* relative to its height, the air cell is provided with a weld line S extending in the longitudinal direction of the cell YY' (transverse direction of the mattress), thereby making it possible to establish a tie between the opposite side faces of the cells and making it possible to limit expansion of the width of the cell and to keep a width that is substantially constant for all of the cells of the central support zone 12C, regardless of the inflation level. In addition, the weld line S extends over only a fraction of the length of the cell, not reaching the longitudinal ends 122 of the cell, in a manner such that vertical end flanks 123 are not separated into two zones, like the zones 121*ca* and 121*cb*, on either side of the weld line S in the middle portion of the cell. In other words, because the zones 121*ca* and 121*cb* communicate with each other at the vertical end flanks 123, the vertical flanks stabilize the two zones 121*ca* and 121*cb* relative to each other, in the vertical direction. In addition, each air cell 121*c* is also provided with a plastics connector, of the tubular orifice type C, welded on the axis of the central weld line, and making it possible to connect a pneumatic pipe or tube communicating with other air cells 121*c* of the same segment 12C, the odd cells being connected together and the even cells also being connected together. At the opposite end of the connector, on the axis of the central weld line, a tubular orifice E is provided that opens out in the face opposite from the face in which the connector C opens out, thereby making it possible to connect the air distribution connection pipe. This configuration for hydraulically linking together the various cells guarantees mechanical stability for all of the individualized cells of the zone 12C.

The therapeutic mattress 12 comprising the two segments 12A and 12B and the central zone 12C is held together physically by plastics press studs on the outer casing 11, which press studs are placed in such a manner as to guarantee that the therapeutic mattress 12 is held together mechanically with effective strength while also being releasable. The plastics press studs make disassembly possible in the event that the therapeutic mattress 12 is replaced in full, or in part, by replacing the segment(s) 12A and/or 12B and/or the central zone 12C.

Although the cells 121*c* of the central zone 12C are of a width that is smaller than the width of the cells 121*a*, 121*b*, the width remains substantially constant regardless of cell inflation pressure, thereby offering the characteristic of improved performance perceived by people recumbent on the mattress 1, in particular when the pressures of the cells 121*a*, 121*b*, 121*c* of the various support zones 12A, 12B, 12C of the therapeutic mattress 12 are regulated by the pneumatic inflation and regulation device 2 in an alternating low-pressure mode as a function of the information received from the pressure sensor 3. In particular, as a function of the positions of the torso-raising portion of the bed on which the support device 1 according to this disclosure is installed as a mattress for accommodating patients, certain patients can feel the polyurethane-coated fabric of the bottom mattress 13 against which they are bearing.

The individual small air cells 121*c* of the central support zone 12C of the therapeutic mattress 12 offer better perception and better support than the cells 121*a*, 121*b*, and better preservation of the skin tissue of the patient, in particular when the torso is raised, because by means of their smaller width, they procure an increased contact surface area in the central support zone 12C on which the sacrum of the patient rests, the sacrum being a portion of the body that is very sensitive and prone to bedsore formation.

As indicated above, the bottom mattress 13 is provided with a recess 132 formed substantially at its center, under the support zone 12C of the therapeutic zone 12, and receiving a pressure sensor 3 making it possible to regulate the pressures of the cells 121*a*, 121*b*, 121*c* of the various support zones of the therapeutic mattress 12. The sensor 3 is optionally a penetration sensor or a pressure sensor as described in the Applicant's European Patents EP 0 676 158 and EP 1 056 372. Since the thickness of the sensor 3 is conventionally less than the thickness of the bottom mattress 13, a small insert 4 is placed on the sensor 3 to take up that difference in thickness and to establish contact between the surface of the sensor and the cells 121*c* of the support zone 12C of the therapeutic mattress 12.

In accordance with one characteristic of an embodiment according to this disclosure, the insert 4 is constituted by an inflatable cushion formed of the same material (in this example, of a thermoplastic polyurethane) as the air cells 121 of the therapeutic mattress 12. Naturally, this inflatable cushion 4 is suitable for being connected like all of the inflatable cells 121, 131 of the therapeutic mattress 12 and of the bottom mattress 13 to the pneumatic inflation and pressure regulation device 2 of the device 1.

The insert 4 made of thermoplastic polyurethane, identical to the material of the therapeutic mattress 12 and placed above the sensor 3, is fed with air at the same pressure as the bottom mattress 13. As a result, it makes it possible to add an additional layer of air under the support zone 12C for supporting the sacrum of the patient, and thus participates in imparting better support while reducing the risk of bedsores forming. The use of the same material for making the cells 121*a*, 121*b*, 121*c* of the therapeutic mattress 12 and of the insert 4 makes it possible to limit the unwanted feelings due to the patient sinking into the mattress, which feelings can be uncomfortable when the therapeutic mattress 12 and the insert 4 are made of mutually different materials.

In a first variant embodiment shown in FIG. 2, the support device 1 according to this embodiment further comprises an intermediate layer 14 disposed between the top layer formed by the inflatable mattress layer 12 and the bottom layer formed by the inflatable mattress 13, the intermediate layer 14 being made up of a plurality of individually inflatable elements or cells 141 forming an intermediate inflatable mattress whose cells 141, like those of the mattresses 12 and 13, are suitable for being connected to the pneumatic inflation and pressure regulation device 2 that is received at the end of the bottom mattress 13.

The bottom mattress layer 14 is usually regulated to the pressure of the therapeutic mattress layer 12, thereby offering a homogeneous bearing surface relative to the sensor 3 received in the recess 132 in the bottom mattress.

The intermediate mattress layer 14 and its air cells 141 are, in some embodiments, formed by flat butt welding together polyurethane-coated polyamide woven fabric sheets, thereby procuring good geometrical shape stability for the intermediate mattress 14 whose main function is to enable the profile and the weight of the body of a patient recumbent on the support device 1 to be better integrated, and to bring all of the cells 121 of the therapeutic mattress to the same level in a horizontal plane.

Regardless of whether the support device 1 of a particular embodiment comprises one, two, or three distinct layers made up of individually inflatable elements or cells such as the three mattress layers 12, 13, 14, each of the inflatable elements 121, 131, 141 is optionally substantially in the shape of an elongate sausage that makes it possible to procure both good flexibility for each of the layers, and in particular for the inflatable elements relative to one another, and also good adaptation of the device 1 to the morphologies of the individuals.

The stack of the mattress layers 12, 13, and 14 also procures improved comfort with the mattresses having their air cells structured in one direction and then the other, e.g. with the therapeutic mattress layer 12 and the bottom mattress layer 13 having transverse welds extending lengthwise in a direction ZZ' perpendicular to the longitudinal direction XX' of the device, and with the intermediate mattress layer 14 having longitudinal welds extending lengthwise parallel to the longitudinal direction XX' of the device.

Figure 5:
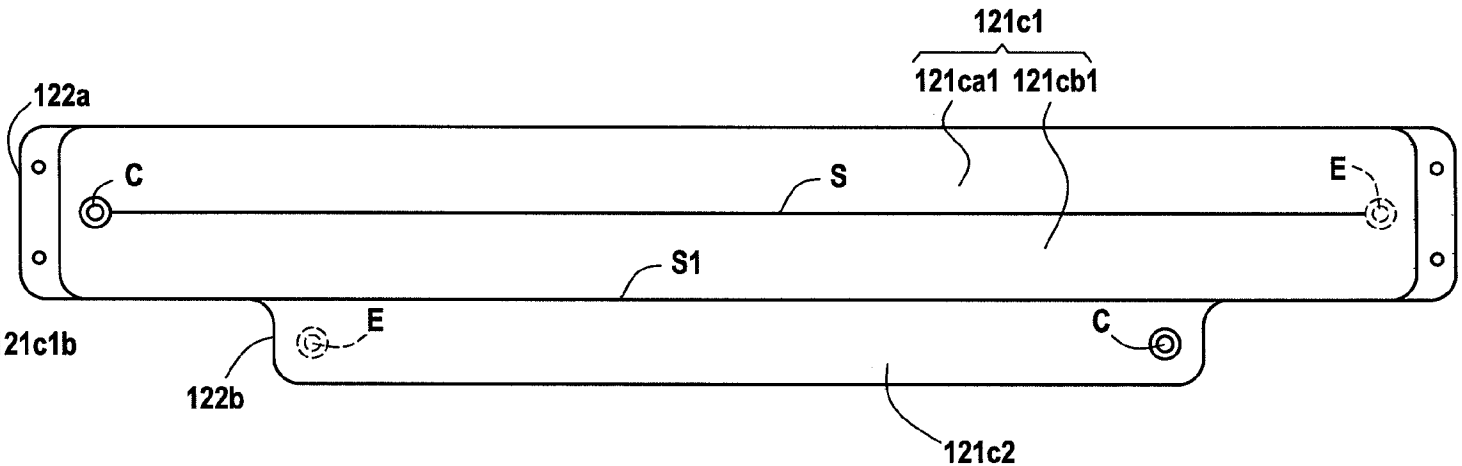
FIGS. 5 and 5A are respectively a front view (FIG. 5) and a side view (FIG. 5A) of an inflatable cell 121*c* of the central support zone 12C of the therapeutic mattress 12 of the support device of the embodiment shown in FIG. 4, and comprising two independent inflation chambers.
Figure 5A:
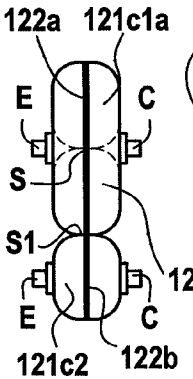
Figure 4:
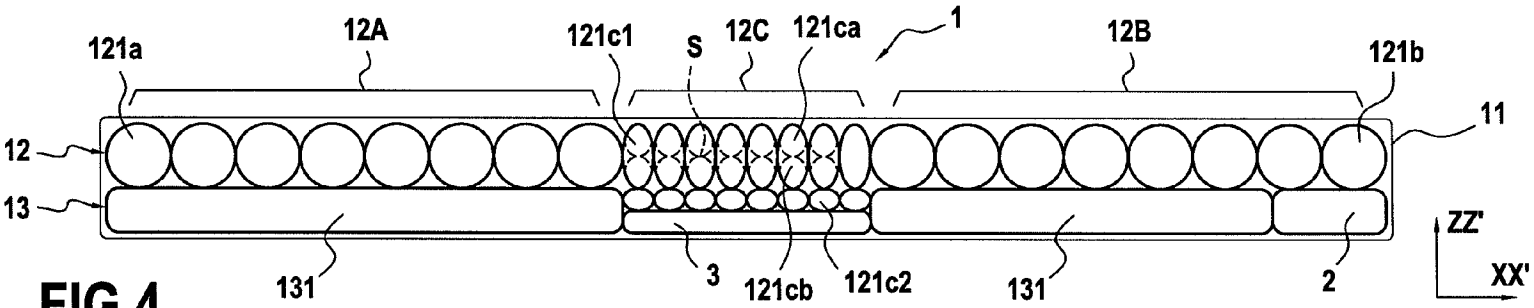
FIG. 4 is diagrammatic longitudinal vertical section view of a mattress constituting a third embodiment of a support device according to this disclosure.

In a third embodiment shown in FIG. 4, each of the individualized elements or cells 121*c* in the central support zone 12C of the top layer 12 is made up of two independent and superposed chambers 121*c*1, 121*c*2 that form respectively a top chamber 121*c*1 of shape and of function identical to those of the cells 121*c* of the therapeutic mattress 12 of the device 1 in the embodiment shown in FIGS. 1 and 2, and a bottom chamber 121*c*2 designed to replace the inflatable cushion 4 between the pressure sensor 3 and the therapeutic mattress 12 as presented in the embodiments shown in FIGS. 1 and 2. Such a cell 121*c* made up of two superposed chambers 121*c*1, 121*c*2 that are separated by a longitudinal weld line S1 extending over their entire length, is shown in FIG. 5.

The chambers 121*c*1, 121*c*2 are, like all of the inflatable elements of the device 1, are suitable for being inflated independently from each other, and each of them is provided with, or co-operates with, at least one pneumatic means, such as an air feed or an air discharge pipe or tube, connected to and suitable for being fed by a pneumatic inflation and pressure regulation device 2 that is situated optionally, as in the case of the preceding embodiments, at one end of the bottom mattress layer 13 under the therapeutic mattress layer.

In some embodiments, the top chamber 121*c*1 has a volume larger than the volume of the bottom chamber 121*c*2, while also having a width equal to the width of the bottom chamber 121*c*2. The top chamber 121*c*1 is, in some embodiments, substantially identical to the air cell having a single chamber 121*c* shown in FIG. 3 and used in the embodiments shown in FIGS. 1 and 2. The top chamber 121*c*1 has a longitudinal side weld line S in its middle relative to its height, not reaching the ends 122 of the chamber, so as to procure geometrical shape stability for the top chamber in width, and the top chamber is provided with a connector or tubular orifice C for feeding air to the chamber 121*c*1, and, at the opposite end and on the opposite face from the connector C, the top chamber is provided with a hole or tubular orifice E for discharging air from the chamber.

Below the top chamber 121*c*1, a bottom chamber 121*c*2 is welded. In practice, it is possible, in some embodiments, for the volume of the top chamber 121*c*1 to be at least in the range 150% to 250% of the volume of the bottom chamber 121*c*2.

In addition, the bottom chambers 121*c*2 of all of the air cells 121*c* communicate with one another and form a backup layer of air in the event of failure of the top portions 121*c*1 of the cells, due, for example, to air leakage generated by damage to the casing of the therapeutic mattress. This backup layer of air makes it possible to support the patient, admittedly not optimally, but while avoiding temporarily any risk of the patient suffering bedsores, pending replacement of the defective cells.

The bottom chamber 121*c*2 of each cell 121*c* communicates with the bottom chamber 121*c*2 of the preceding or following air cell 121*c*. However, the bottom chambers 121*c*2 are fed with air independently from the top chambers 121*c*1 of the air cells 121*c*, and cannot communicate with the top chambers in the illustrative embodiments. Each of the bottom chambers 121*c*2 is thus closed by the weld line S1 that extends over its entire length, and is substantially leaktight, and it is provided with two welded plastics connectors or tubular orifices C making it possible to connect it to the other bottom chambers 121*c*2 of the preceding and following air cells 121*c*. Finally, the bottom chamber 121*c*2 of each air cell 121*c* is, by being of length shorter than the length of the top chamber 121*c*1, designed in such a manner as to fit into the recess 132 in the bottom mattress 13, in which recess it is stabilized in the vertical position relative to the top chamber 121*c*1, then replacing the insert 4 used in the embodiment shown in FIGS. 1 and 2.

It can be understood that the longitudinal ends of the top chambers 121*c*1 rest on the longitudinal portions of the bottom mattress layer 13, and co-operate with the adjacent zones 131 of the mattress layer 13 to define the central recess 132 in which the sensor 3 is also received on the undersides of the bottom chambers 121*c*2.

This embodiment of the support device 1 according to this disclosure consists in structuring the air cells 121*c* of the central support zone 12C of the therapeutic mattress layer 12 in such a manner as they themselves present a backup zone made up of the bottom chambers 121*c*2. This embodiment offers the characteristic of simplifying the entire structure of the support device 1 and of having the entire height of the cells 121*c* available for optimally positioning the risk region represented by the sacrum of the patient in the therapeutic mattress layer 12, thereby optimally distributing the bearing points of the sacrum zone regardless of the operating mode of the device and of the pressure regulation modes for regulating the pressures of the cells 121, 131 of the therapeutic mattress layer 12 and of the bottom mattress layer 13 respectively, i.e. alternating-pressure or continuous-pressure regulation, and regardless of the position of the torso-raising portion of the bed of the patient.

Regardless of the embodiment of the support devices 1 contemplated herein, the comfort perceived by the patients is increased considerably relative to that of conventional foam mattresses or to that of existing inflatable-cell mattresses. In addition, the support devices 1 contemplated by this disclosure make it possible to guarantee increased prevention and increased treatment of bedsores and of wounds in patients, in particular in the critical zone of the sacrum, by making the central support zone 12C of the therapeutic mattress of higher cell density relative to the other zones 12A and 12B, which higher density of cells can optionally be extended to all of the support zones 12A, 12B, 12C of the therapeutic mattress 12 of the device 1, if desired.

Superposing the therapeutic mattress layer 12 and the bottom mattress layer 13 and optionally an intermediate mattress layer 14, all of which mattress layers are formed of individually inflatable elements, each of which is connected via air feed and/or discharge means such as solenoid valves and pipes/tubes to a pneumatic inflation and regulation device 2, procures support that is adaptable to each patient as a function of the morphology and of the weight of the patient, and, what is more, dynamically by acting on the inflation modes for inflating the cells of the mattress layers 12, 13, 14 of the device 1, and on their inflation pressures as a function of the parameters measured by the sensor 3 that is connected directly to the control device 2 for controlling inflation and regulation.

As a result of all of the structural parameters of the support devices 1 of this disclosure, comfort is procured that is optimized and appropriate for each patient.

In addition, since the cells 121*c* of the zone 12C are individual, they offer larger-scale mass production possibilities than those offered by a complete one-piece mattress. They also procure the characteristic of being replaceable individually and of being safer in the event that one of them is damaged, thereby avoiding the need to replace the entire support device.

Another original structural characteristic of the support devices 1 contemplated herein also makes it possible, regardless of the embodiment of the cells 121*c* of the central support zone 12C of the therapeutic mattress layer 12, to improve comfort and to improve performance in terms of support and of bedsore prevention in another vulnerable zone of the patient's body, namely the zone of the heels, that region of the body presenting bony protuberances and low soft-tissue thickness.

Figure 6:
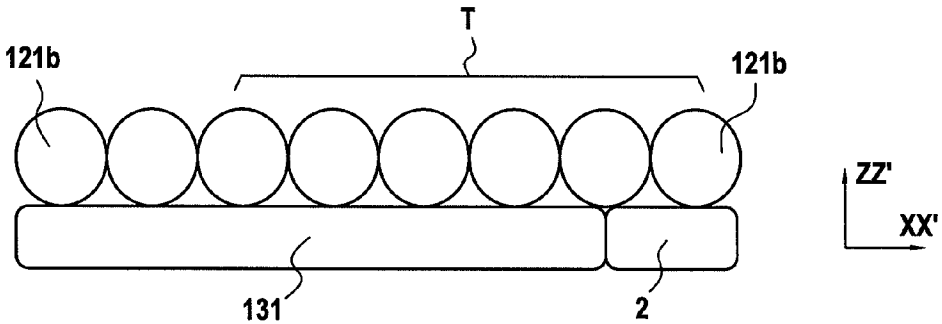
FIG. 6 is a view on a larger scale of the support zone 12B of a support device according to this disclosure in one of the embodiments shown in FIGS. 1 to 3.

In one of its configurations, as shown in FIGS. 1, 2, and 4, and in detail in FIG. 6, the zone T of the therapeutic mattress layer 12 that is dedicated to supporting the heels of patients recumbent on the device 1 is made up of air cells 121*b* that are substantially identical to the air cells of the entire support zone 12B for supporting the legs, and that are substantially identical to the cells 121*a* of the support zone 12A for supporting the torso. The cells 121*b* are typically formed by flat butt welding together two thermoplastic polyurethane sheets, and are inflated to a very low pressure, typically of the order of 6 millimeters (mm) of mercury, i.e. about 800 pascals (Pa), in a manner such as to fit around the shape of the bony protuberances as well as possible and such as to impede the blood circulation as little as possible in this region.

After numerous campaigns of tests conducted for understanding the phenomena involved in bedsore formation and in treating and preventing bedsores in patients at risk, the Applicant has observed that, for supporting the heels, the cells 121*b* suffer from the drawback of being of relatively large size, typically 10 centimeters (cm) in diameter, and the heel support characteristics, in particular the interface pressure, can be affected by a certain amount of variability as a function of the positioning of the heels relative to the tops of the air cells or to the spaces between the air cells.

In addition, support for the leg is no different from support for the heels, and therefore a possible consequence is that, in tall slim patients, the entire leg sinks in and the interface pressure decreases at the heels.

Figure 7:
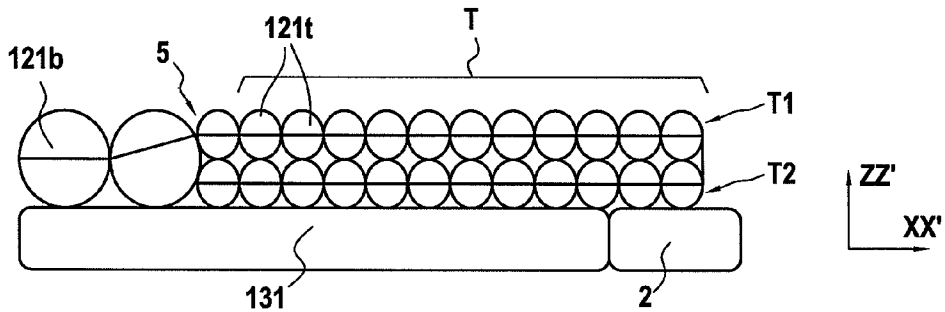
FIG. 7 is a view on a larger scale of the support zone 12B of a support device according to this disclosure, in one of the embodiments presented in FIGS. 1 to 4, and that has a particular structure for the specific heel support zone T in the support zone 12B.

That is why, in accordance with the teachings of the present disclosure, and as shown in FIG. 7, the support device 1 proposes, in the specific portion T of the support zone 12B that is designed to support the heels, to use a plurality of inflatable elements 121*t* of height and of width proportionally smaller than the height and width of the other cells 121*a*, 121*b*, 121*c* of the various support zones 12A, 12B, 12C of the therapeutic mattress 12, and typically half as high and half as wide as the cells 121*a* and 121*b* for an identical length, which inflatable elements 121*t* are disposed in two layers T1 and T2.

The inflatable elements 121*t* are distributed into superposed layers (two layers T1, T2 in this example) whose total height is equal to the height of the other inflatable elements 121*a*, 121*b*, 121*c* of the therapeutic mattress layer 12 of the support device 1. Each of the inflatable elements 121*t* is provided with, or cooperates with, at least one pneumatic means for feeding and/or discharging air, and the elements 121*t* are thus pneumatically independent and thus suitable for being inflated independently from one another. In addition, the bottom layer is suitable for being locked in a substantially leaktight manner independently of the top layer, thereby making it possible to offer a backup support in the event that the top layer is damaged. For this purpose, they are connected to, and suitable for being actuated by, the pneumatic inflation and pressure regulation device 2.

By using such cells 121*t* of specific format that are disposed in two layers T1, T2 in the portion T of the therapeutic mattress 12, it is possible, when a patient is, for example recumbent on the device 1, to inflate and to regulate the pressures of the elements 121*t* of the top layer T1 to a very low pressure, i.e. to 6 mm of mercury, while the elements of the bottom layer T2 are inflated and regulated to the pressure of the central zone 12C of the therapeutic mattress 12 and of the bottom mattress 13, which pressure is typically 20 mm of mercury, i.e. about 2700 Pa, as a function of the morphology and of the position of the patient. The bottom layer T2 regulated to the higher pressure then makes it possible, functionally, to support the leg better, and thus to improve the penetration of the heels, while also keeping them in line with the legs.

In a variant embodiment, the superposed layers T1, T2 in the zone T are obtained through inflatable elements 121*t* that each comprise at least two superposed inflation chambers that are secured together in a manner similar to the way in which cells 121*c* of the central zone 12C in the embodiment shown in FIG. 3 are secured together, the two chambers of each of the elements 121*t* possibly however being of identical volume and of identical shape, but being regulated to different pressures, e.g. 6 mm of mercury for the top portion and 20 mm of mercury for the bottom portion. The zone T can then also be controlled in alternating-pressure mode, e.g. by deflating alternately one cell in every two or by slightly over-inflating one cell in every two, typically to 10 mm of mercury.

As in the embodiment shown in FIG. 7, each of the two chambers of each of the elements 121*t* is provided with or cooperates with at least one air feed and/or discharge pneumatic means connected to and suitable for being actuated by the pneumatic inflation and pressure regulation device 2 incorporated into the device, thereby making it possible to inflate and to regulate the air pressure inside each of the chambers independently.

In another variant embodiment, the inflatable elements 121*t* in the zone T can also be made up of individually inflatable sausage-shaped elements 121 that are secured together in such a manner as to form a cushion 5, e.g. obtained by welding together two sheets of polyurethane, the cushion 5 being folded over onto itself so as to form at least two layers T1, T2 of inflatable sausage-shaped elements stacked one above the other. Also in this embodiment, each of the inflatable elements 121*t* of the cushion 5 is provided with, or cooperates with, at least one air feed and/or discharge pneumatic means such as a solenoid valve connected to and suitable for being actuated by the pneumatic inflation and pressure regulation device 2 that is incorporated into the device 1.

Regardless of the embodiment chosen, it is possible, for the comfort of the patient, for the inflatable elements 121*t* in the zone T designed to support the heels of an individual recumbent on the device to be made of the same material as the material of the other inflatable elements 121*a*, 121*b*, 121*c* of the therapeutic mattress layer 12, and to be made, for example, of thermoplastic polyurethane suitable for collecting human body heat so as to match as well as possible the shapes of the bony protuberances and other curves of the patients' bodies.

The invention claimed is:

1. A mattress device comprising, inside at least one outer casing:

at least one inflatable top layer made up of a plurality of adjacent elements that are secured together and that are individually inflatable with a fluid via a pneumatic inflation and pressure regulation device;

at least one bottom layer supporting said top layer and provided with a recess; and a penetration and/or pressure sensor received in the recess and connected to said pneumatic inflation and pressure regulation device, said sensor making it possible to determine the penetration and/or the pressure applied locally by the body of an individual bearing against the inflatable top layer and to regulate the inflation pressures of said elements of said top layer correspondingly;

wherein, in a substantially central support zone designed to support the sacrum zone of the individual's body, said top layer is made up of a plurality of inflatable elements that are individualized in unitary manner, and that are each of a width smaller than their height for better preservation of the skin tissue, the width of said individualized inflatable elements of said central support zone being smaller than a width of each of the inflatable elements of opposite end zones situated adjacent to opposite ends of said central support zone; wherein said sensor, said recess, and said central support zone are of substantially equivalent length along a long dimension of the mattress device.

2. The mattress device according to claim 1, wherein the width of said inflatable elements in said central support zone that are individualized in unitary manner is substantially constant regardless of the level of inflation of said individualized inflatable elements.

3. The mattress device according to claim 1, wherein said individualized elements in said central support zone are constituted by cells extending transversely relative to the longitudinal direction of the mattress device and disposed side-by-side in the longitudinal direction of the mattress device, the opposite side faces of each cell being connected together by tie means giving them a width that is substantially constant regardless of their level of inflation.

4. The mattress device according to claim 3, wherein said tie means are constituted by a longitudinal weld line extending over a portion of the length of said cells, and not reaching their ends, said weld line being situated substantially in the middle relative to the height of the cell.

5. The mattress device according to claim 1, wherein the width of said inflatable elements in said central support zone of said top layer is at least 25% smaller than their height.

6. The mattress device according to claim 1, wherein said inflatable elements of said top layer are made of a thermoplastic polymer material that is based on polyurethane.

7. The mattress device according to claim 1, wherein each of said inflatable elements of the top layer, regardless of whether it is in said central support zone or in one of said end zones, is provided with or co-operates with at least one pneumatic air feed and/or discharge means connected to and suitable for being fed by a said pneumatic inflation and pressure regulation device.

8. The mattress device according to claim 1, wherein said bottom layer is made up of a plurality of elements that are individually inflatable and that are suitable for being connected to a said pneumatic inflation and pressure regulation device.

9. The mattress device according to claim 1, wherein said bottom layer is made up of a plurality of individually inflatable elements made of a material of flexibility and of heat-sensitivity that are lower than those of the material of which the inflatable elements of the top layer are formed.

10. The mattress device according to claim 1, further comprising an intermediate layer disposed between said top layer and said bottom layer.

11. The mattress device according to claim 10, wherein said intermediate layer is made up of a plurality of individually inflatable elements that are suitable for being connected to said pneumatic inflation and pressure regulation device.

12. The mattress device according to claim 11, wherein said individually inflatable elements of said top layer, of said bottom layer, and of said intermediate layer are substantially in the shape of elongate sausages, and wherein said inflatable elements of said top layer and of said bottom layer extend lengthwise in a direction perpendicular to a longitudinal direction of the mattress device, and said inflatable elements of said intermediate layer extending lengthwise parallel to said longitudinal direction of the mattress device.

13. The mattress device according to claim 1, further comprising an inflatable cushion situated between said individualized elements of said central support zone and said sensor, the inflatable cushion being connected to said pneumatic inflation and pressure regulation device.

14. The mattress device according to claim 13, wherein said inflatable cushion is made of a thermoplastic polyurethane.

15. The mattress device according to claim 1, wherein each of said individualized elements in said central support zone of the top layer comprises two independent and superposed inflation chambers.

16. The mattress device according to claim 1, wherein each of said individualized elements in said central support zone comprises a top chamber and a bottom chamber, said top chamber having a volume larger than the volume of said bottom chamber and a width and a length equal to those of said bottom chamber, the volume of said top chamber being at least in the range 150% to 250% of the volume of said bottom chamber, said top and bottom chambers of each of said individualized elements in said central support zone of the top layer being separated by a weld line extending over their entire length and thus being suitable for being inflated independently from each other, and each of said top and bottom chambers being provided with or co-operating with at least one pneumatic air feed and/or discharge means connected to and suitable for being actuated by said pneumatic inflation and pressure regulation device, each of said top chambers having a said longitudinal weld line that does not reach its ends.

17. The mattress device according to claim 16, wherein said top chambers form the top layer of said central support zone and said bottom chambers are of length shorter than the length of the top chambers in the transverse direction of said mattress device and are received and held in said recess in the bottom layer above said sensor.

18. The mattress device according to claim 1, wherein at least a portion of a heel support zone of said top layer that is distinct from the central zone and arranged to support the heels of the individual recumbent on the mattress device, is made up of a plurality of inflatable elements of height and of width that are smaller than those of the inflatable elements in the end zones of said top layer, and wherein they the inflatable elements of the heel support zone are distributed into superposed layers whose total height is equal to the height of the inflatable elements of said end zones.

19. The mattress device according to claim 18, wherein the inflatable elements in said heel support portion of the top layer are inflated independently from one another, and each of them is provided with or co-operates with at least one pneumatic air feed and/or discharge means connected to and suitable for being actuated by said pneumatic inflation and pressure regulation device.

20. The mattress device according to claim 18, wherein each of said inflatable elements in said heel support zone comprises at least two superposed and secured-together inflation chambers that are of substantially identical volume and of substantially identical shape, and that are suitable for being inflated independently from each other and each provided with or co-operating with at least one pneumatic air feed and/or discharge means connected to and suitable for being actuated by said pneumatic inflation and pressure regulation device.

21. The mattress device according to claim 18, wherein said inflatable elements in said heel support zone are constituted by sausage-shaped tubes that are individually inflatable and that are secured together in such a manner as to form a cushion, said cushion being folded over on itself in such a manner as to form at least two layers of inflatable sausage-shaped tubes that are stacked one above the other.

22. The mattress device according to claim 18, wherein said inflatable elements in said heel support zone are made of a thermoplastic polyurethane.

* * * * *